US006209283B1

(12) United States Patent
Folkersen

(10) Patent No.: US 6,209,283 B1
(45) **Date of Patent: *Apr. 3, 2001**

(54) SEALED ROOF AND METHOD FOR SEALING A ROOF

(76) Inventor: Jonny Folkersen, P.O. Box 191, West Boylston, MA (US) 01583

( * ) Notice: Subject to any disclaimer, the term of this patent is extended or adjusted under 35 U.S.C. 154(b) by 0 days.

This patent is subject to a terminal disclaimer.

(21) Appl. No.: 09/447,605

(22) Filed: Nov. 23, 1999

Related U.S. Application Data

(63) Continuation-in-part of application No. 09/032,202, filed on Feb. 27, 1998, now Pat. No. 6,023,906.

(51) Int. Cl.[7] ..... E04D 1/00

(52) U.S. Cl. ..... 52/746.11; 52/746.1; 52/748.1; 52/409; 52/518; 52/DIG. 16

(58) Field of Search ..... 52/746.1, 746.11, 52/747.1, 748.1, 748.11, DIG. 16, 741.1, 409, 518

(56) References Cited

U.S. PATENT DOCUMENTS

| | | |
|---|---|---|
| 1,418,377 | 6/1922 | Jaynes . |
| 2,044,782 | 6/1936 | Harshberger et al. . |
| 2,144,168 | 1/1939 | Sherriff . |
| 2,226,239 | 12/1940 | Elmendorf . |
| 2,246,514 | 6/1941 | Hardy . |
| 2,394,380 | 2/1946 | Herbes . |
| 4,825,616 | 5/1989 | Bondoc et al. . |
| 4,932,171 | 6/1990 | Beattie . |
| 5,512,118 | 4/1996 | Davis et al. . |

OTHER PUBLICATIONS

Data sheet of Protecto Wrap, "Rainproof–40/Rainproof–60, High Performance Roof Underlayment For Minimum 2"/12" Roof Pitches", 1 page.

Data sheet of Protecto Wrap's, "Jiffy Seal Ice & Water Guard, Protecto Wrap's Answer To The Roof Ice Dam Problem.", 1 page.

Data sheet of Protecto Wrap, "Rainproof TM", 1 page.

Data sheet of Protecto Wrap, "Rainproof II, High Performance Nail–on Tile Roof Underlayment/Ice & Water Guard", 1 page.

Data sheets of Protecto Wrap, "Waterproofing, Performed SBS Sheet", date listed Jan. 1995, 4 pages.

Data Sheet of Protecto Wrap, "PW–100–60 Sheet Membrane Waterproofing System", date listed—Feb. 1995, 1 page.

*Primary Examiner*—Beth A. Stephan
*Assistant Examiner*—Brian E. Glessner
(74) *Attorney, Agent, or Firm*—Robert W. Nelson

(57) ABSTRACT

A sealed roof and a method of sealing a roof is disclosed. The sealed roof is of the type having a inclined substrate with a first layer of shingles attached thereto. A waterproof membrane is adhered to at least a portion of the first layer of shingles. A second layer of shingles is placed over the waterproof membrane and attached to the substrate.

24 Claims, 7 Drawing Sheets

SEALED ROOF AND METHOD FOR SEALING A ROOF

This application is a Continuation-in-Part of U.S. application, Ser. No. 09/032,202 filed on Feb. 27, 1998, now U.S. Pat. No. 6,023,906, which is hereby incorporated by reference for all that is disclosed therein.

FIELD OF THE INVENTION

The present invention generally relates to a sealed roof and, more particularly, to a pitched, shingled roof having a first layer of shingles, a second layer of shingles, and a waterproof membrane located therebetween.

BACKGROUND OF THE INVENTION

Many structures have pitched, shingled roofs, which prevent water, e.g., rain water, from entering the structures by causing water to pass over the shingles and off the roofs. A pitched, shingled roof has a pitched substrate, such a plurality of plywood sheets, with a plurality of shingles attached thereto.

Each shingle has an upper portion and a lower portion wherein the lower portion is exposed to the environment. The shingles are typically attached to the substrate in rows wherein the lower portions an upper row of shingles overlaps the upper portions of an adjacent lower row of shingles. For example, a first row of shingles may be attached to the substrate nearest the lowest point of the roof, i.e., the eave portion of the roof. A second row of shingles may then be attached to the substrate slightly higher on the roof than the first row. The shingles are placed so that the lower portions of the second row of shingles overlaps the upper portions of the first row of shingles. This overlapping continues with successive rows of shingles to the highest point on the roof. Thus, only the lower portions of the shingles are exposed to the environment. This overlapping of the shingles causes water to pass from shingles on a high row shingles to shingles on the next lowest row of shingles without contacting the substrate. Accordingly, water passes from shingle to shingle and off the roof without contacting the substrate or entering the structure.

Attaching the shingles to the roof is typically achieved by the use of nails or other fastening devices that pass through the shingles and into or through the substrate. The fastening devices are typically placed through the upper portions of the shingles so that they are overlapped by shingles in an adjacent higher row as described above. This placement of the fasteners prevents water from entering the structure through holes caused by the fasteners.

Some roofs have a membrane located between the substrate and the shingles. The membrane may, as an example, be conventional tar paper that is nailed to the substrate. The tar paper-type membrane is typically manufactured from a paper product and, thus, does not have a high degree of integrity. Strips of the membrane are typically attached to the roof in an overlapping fashion wherein an upper strip overlaps its adjacent lower strip. Accordingly, the membrane serves to shield the substrate from water should a shingle become damaged. For example, if a shingle becomes cracked or otherwise leaks, water will contact the membrane rather than the substrate. Water will then pass along the membrane to the next lowest shingle without contacting the substrate or entering the structure. Alternatively, water will pass along the membrane, under the shingles and off the roof. Many membranes, however, are susceptible to passing water to the substrate and into the structure. For example, when nails are used to attach the shingles to the substrate, the nails pass through the membrane and, accordingly, make holes in the membrane. In the event water contacts the membrane, these holes may allow water to pass through the substrate and into the structure.

Even with overlapping shingles and membranes as described above, conventional pitched, shingled roofs are susceptible to water leakage, which can damage their underlying structures. For example, if the membrane is damaged, i.e., it tears, it will not be able to shield the substrate from water. Thus, if a shingle in the proximity of the damaged membrane also becomes damaged, water will contact the substrate and may enter the underlying structure. Tar paper and similar membranes tend not be durable and further tend to tear when subjected to minimal force and are, accordingly, susceptible to leaking.

Another way for water to enter the underlying structure is by the formation of an ice dam on the roof. An ice dam forms when water flows down a roof and encounters a portion of the roof that is below freezing. When the water encounters the portion of the roof that is below freezing, it freezes and forms an ice sheet. As water continues to flow onto the portion of the roof that is below freezing, the ice sheet thickens and eventually forms a barrier or ice dam. The water on the relatively warm portion of the roof that is above freezing, does not freeze and accumulates as a pool of standing water. This standing water eventually seeps underneath the shingles. The water then encounters the substrate and may pass into the underlying structure. The aforementioned tar paper-type membranes generally do not seal the roof against standing water such as caused by an ice dam. For example, water standing behind the ice dam seeps under the shingles and between the strips of the membrane. The water may then contact the substrate and pass into the structure. In another example, the standing water may pass under the shingles and contact a nail hole in the membrane. The water may then follow the nail hole into the structure.

One of the causes of ice dams is due to melting snow caused by heat passing through the roof. The situation typically arises with a roof having an eave and an accumulation of snow located thereon when the outside air temperature is below freezing. An eave is a portion of the roof that extends horizontally beyond the underlying structure. Due to the cold outside air temperature, the interior of the underlying structure is heated. This causes heat to rise through the structure and heat the roof. Because the eave portion of the roof extends horizontally beyond the underlying structure, it will not be heated. The snow accumulation on the roof forms an insulating barrier between the heated roof and the cold outside air. When enough heat passes into the roof to raise the roof temperature above freezing, the snow adjacent the roof melts. The water from the melting snow passes down the roof under the snow and toward the eave portion of the roof. The eave portion, however, is below freezing because it is not heated by extraneous heat escaping from the underlying structure. Thus, when the water from the melting snow passes over the portion of the roof covering the eave, it freezes. As the snow continues to melt, more water passes over the eave portion of the roof and freezes. Eventually, ice builds up on the eave portion of the roof and forms a barrier or ice dam, which prevents water from running off the roof. The water then backs up on the roof and seeps under the shingles to the substrate. If there are any holes in the substrate, the water will pass through the holes and into the structure as described above.

When a roof is found to leak upon the formation of an ice dam, the most practical method of alleviating the leakage problem is to seal the substrate. Sealing the substrate, however, requires the removal of the shingles in order to access the substrate. The shingles typically cannot be salvaged and, accordingly, must be discarded. The substrate is then sealed and a new layer of shingles is attached to the substrate. This process is costly due to the cost of removing the existing shingles, the replacement cost for new shingles, and the disposal cost of the discarded shingles. In addition, the removal of the shingles may cause damage to the substrate, which must be repaired prior to the application of new shingles and further increases the cost of sealing the roof.

A waterproof membrane is typically used to seal the substrate. For example, a membrane may be adhered to the substrate to form a waterproof sheet on the substrate. Accordingly, water is prevented from contacting the substrate and entering the structure. Some roofs are constructed with such a waterproof membrane affixed to the substrate prior to the application of the shingles. Should the membrane become damaged for any reason, however, the roof may be susceptible to leaking upon the formation of an ice dam. The aforementioned process of removing the shingles to reseal the roof must then be performed. The process, however, has the additional burden of replacing the membrane, which may cause significant damage to the substrate if it is adhered to the substrate.

Therefore, a need exists for a method of sealing a roof that does not require removal of the existing roofing shingles.

SUMMARY OF THE INVENTION

A sealed roof and a method for sealing a roof are disclosed herein. The sealed roof may comprise a substrate located upon a structure. The substrate may have a first side and a second side oppositely disposed the first side, wherein the first side faces the structure. The sealed roof may have a first layer of shingles, wherein the first layer of shingles has a first side and a second side. The first layer of shingles may be attached to the substrate so that the first side of the first layer of shingles is adjacent to the substrate second side. A waterproof membrane may be placed adjacent at least a portion of the first layer of shingles, wherein the membrane has a first surface and a second surface, and wherein the membrane first surface is placed adjacent the second side of the first layer of shingles. A second layer of shingles may be placed adjacent the membrane second surface and attached to the substrate.

The method may comprise providing a roof having a first layer of shingles attached to a substrate. The method may further comprise placing a waterproof membrane adjacent at least a portion of the first layer of shingles. A second layer of shingles may then be attached to the substrate.

DETAILED DESCRIPTION OF A PREFERRED EMBODIMENT

Figure 1:
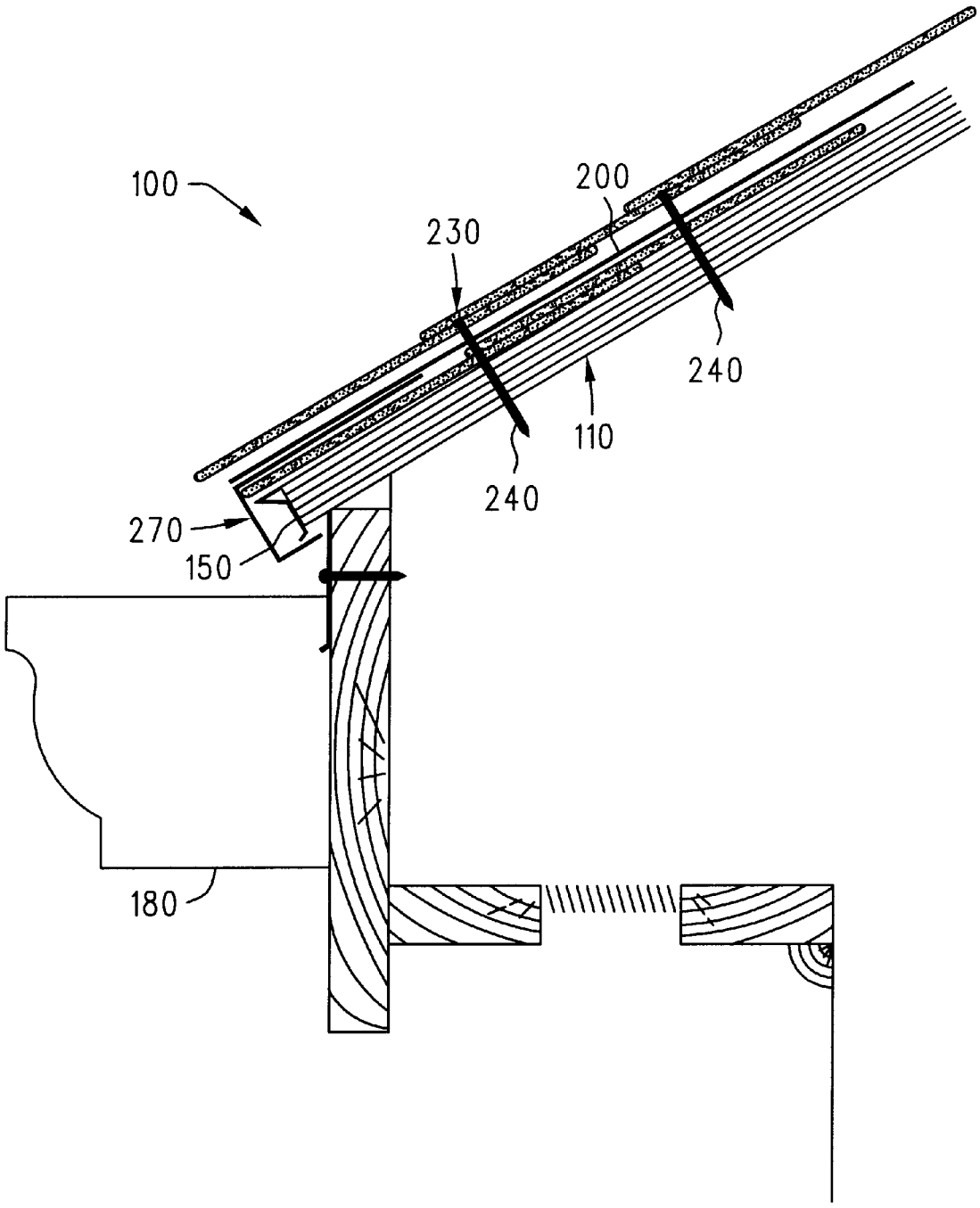
FIG. 1 is a side cut away view of a sealed roof.

FIGS. 1 through 7, in general, illustrate a method for sealing a roof 108 wherein the roof 108 is of the type comprising an inclined substrate 110 and a first layer of shingles 112, wherein the first layer of shingles 112 has a first side 128 and a second side 126, and wherein the first layer of shingles first side 128 is attached to the substrate 110. The method may comprise: providing a waterproof membrane 200 having a first side 212 and a second side 210; providing a second layer of shingles 230; positioning the membrane first side 212 adjacent at least a portion of the first layer of shingles second side 126; attaching the second layer of shingles 230 to the substrate 110, wherein the second layer of shingles 230 is adjacent the membrane second side 210.

FIGS. 1 through 7 also, in general, illustrate a roof 100 comprising: an inclined substrate 110 having a surface 114; a first layer of shingles 112 attached to the substrate surface 114, the first layer of shingles 112 having a first surface 128 and a second surface 126, wherein the first layer of shingles first surface 128 is adjacent the substrate surface 114; a membrane 200 having a first surface 212 and a second surface 210, wherein the membrane first surface 212 is positioned adjacent at least a portion of the first layer of shingles second surface 126; and a second layer of shingles 230 located adjacent at least a portion of the membrane second surface 212.

Having generally described the sealed roof 100, it will now be described in greater detail.

Referring to FIG. 1, a sealed roof 100 and a method of sealing a roof are disclosed herein. The method disclosed herein describes the process of sealing a conventional roof 108, FIG. 2, to achieve the sealed roof 100 of FIG. 1. Accordingly, the following description describes the conventional roof 108 of FIG. 2 and is followed by a description of the method to achieve the sealed roof 100 of FIG. 1.

Figure 2:
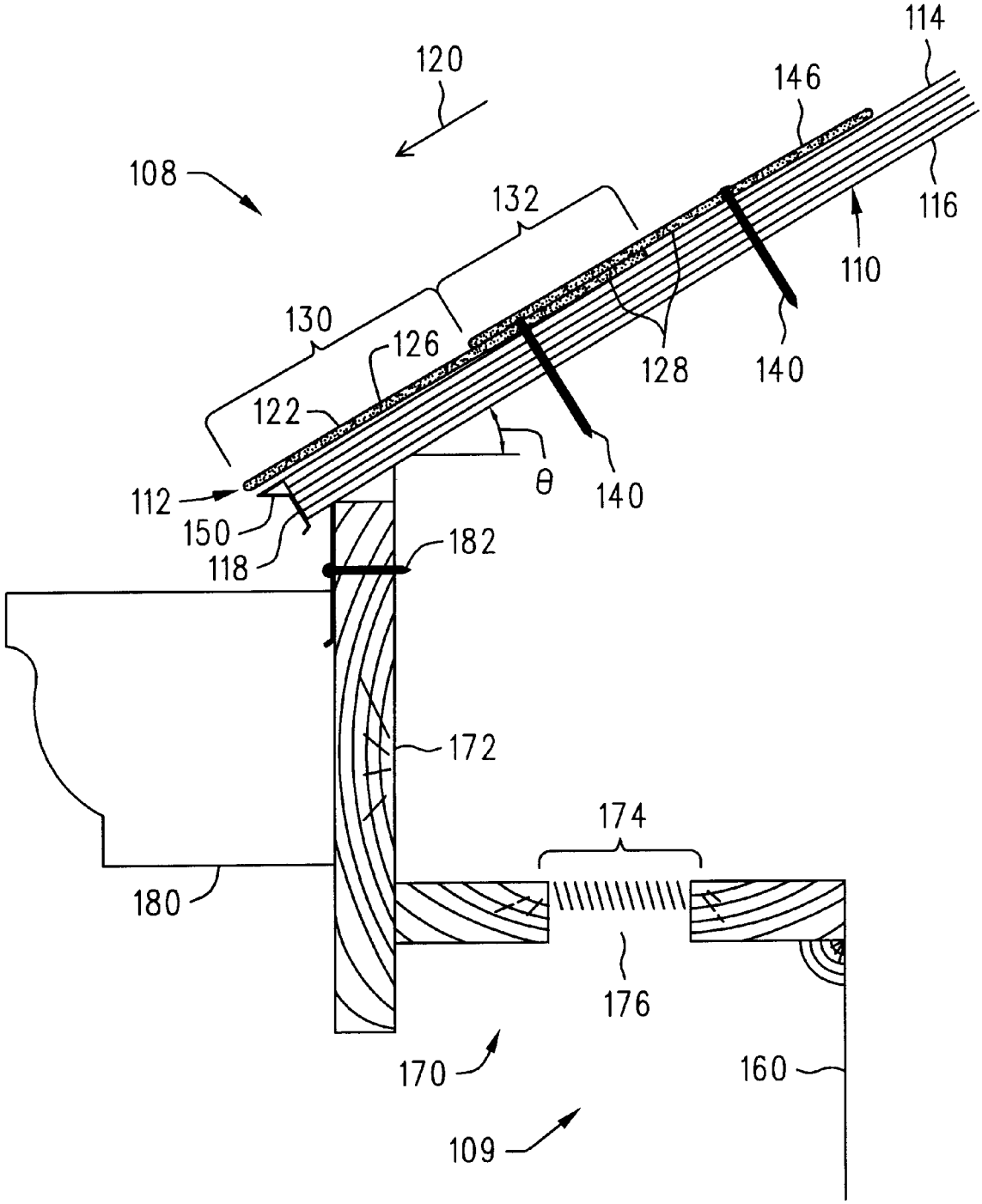
FIG. 2 is a side cut away view of a conventional roof.

Referring to FIG. 2, which is a cut away view of the conventional roof 108, the conventional roof 108 is described herein in a non-limiting manner as being part of a structure 109, such as a house. The conventional roof 108 sets upon the structure 109 and serves to keep precipitation, such as rain and snow, from entering the structure 109. The conventional roof 108 typically has a substrate 110 with a layer of shingles 112 attached thereto. The substrate 110 may, as a non-limiting example, be a plurality of plywood sheets. The substrate 110 has a top side 114, a bottom side 116, and an end 118. The top side 114 is a surface that faces away from the structure 109 and the bottom side 116 is a surface that faces toward the structure 109. The substrate 110 is inclined at an angle θ relative to the earth, which is known in the art as the pitch of the roof. This incline forces water to flow in a direction 120 off the roof.

The shingles 112 are described herein in a non-limiting manner as being conventional roofing shingles. The shingles 112 may, as examples, be asphalt or fiberglass based roofing shingle as are known in the art. With reference to a first shingle 122, all the shingles 112 may have a top side 126, a bottom side 128, an exposed portion 130 and an overlapped portion 132. During construction of the conventional roof 108, the first shingle 122 may be placed on the top side 114 of the substrate 110 so that the bottom side 128 of the first shingle 122 is adjacent the top side 114 of the substrate 110. The exposed portion 130 of the first shingle 122 typically extends slightly beyond the end 118 of the substrate 110 so as to keep water from contacting the substrate 110. A fastener 140, such as a nail, may be placed through the overlapped portion 132 of the first shingle 122 and into the substrate 110, thus, securing the first shingle 122 to the substrate 110. It should be noted that several fasteners 140 are typically used to secure the first shingle 122 to the substrate 110 and that the fastener 140 typically extends through the substrate 110.

After the first shingle 122 is secured to the substrate 110, a second shingle 146 is secured to the substrate 110. The exposed portion 130 of the second shingle 146 is placed over the overlapped portion 132 of the first shingle 122. Again, a fastener 140, such as a nail, is used to secure the second shingle 146 to the substrate 110. This overlapping of shingles 112 continues along the substrate 110, opposite the direction 120, until the substrate 110 is covered with shingles 112. Accordingly, the substrate 110 is covered with shingles 112 wherein the exposed portions 130 of the shingles 112 are exposed to the environment. It is to be understood that a plurality of fasteners 140 are typically used to secure each shingle 112 to the substrate 110.

Figure 3:
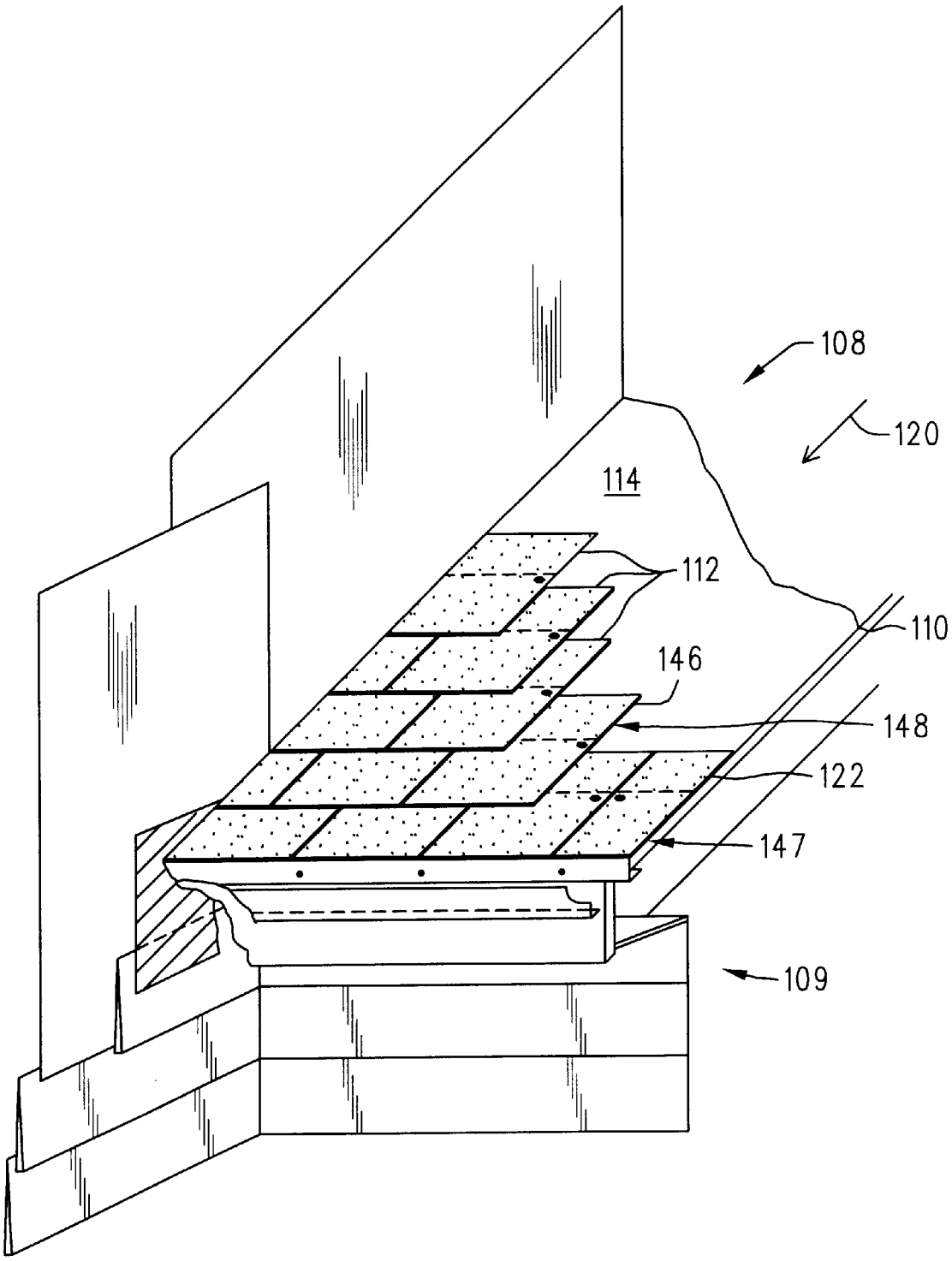
FIG. 3 is a top perspective view of the roof of FIG. 2.

Referring to FIG. 3, which is a top perspective view of the conventional roof 108, the shingles 112 are typically attached to the substrate 110 in rows. The first shingle 122 is attached to the substrate 110 along with other shingles 112 to form a first row 147. Subsequent to the attachment of the first row 147 to the substrate 110, the second shingle 146 and other shingles 112 are attached to the substrate 110 to form a second row 148. Attaching the shingles 112 to the substrate 110 in rows provides for the second row 148 to overlap the first row 147 over the length of the substrate 110. Accordingly, an upper row of shingles 112 overlaps its adjacent lower row of shingles 112. Water may then pass from an upper row of shingles 112 to its adjacent lower row in the direction 120 without contacting the substrate 110.

The rows 147, 148 have been described herein as being made of individual shingles 112. It is to be understood, however, that this is for illustration purposes only and that the rows 147, 148 may be made in various other forms. For example, the shingles 112 forming the rows 147, 148 may be extended sheets that are rolled onto the substrate 110 to form the rows 147, 148.

Referring again to FIG. 2, a conventional drip edge 150 may be affixed to the substrate 110 in the proximity of the end 118. The drip edge 150 is typically positioned between the first shingle 122 and the substrate 110 and serves to divert water away from the end 118 of the substrate 110 in a conventional manner.

Having described the substrate 110 and the conventional roof 108, the remaining elements of the structure 109 will now be described in a non-limiting manner.

The structure 109 described herein has a conventional exterior wall 160 located below the conventional roof 108. The exterior wall 160 defines the boundaries of the structure 109 and serves to support the conventional roof 108 in a conventional manner. The structure 109 also has an eave 170 located below the substrate 110 and adjacent the exterior wall 160. The eave 170 extends horizontally from the exterior wall 160 and may serve to keep water from dripping onto the exterior wall 160. The eave 170 is shown as having a first member 172 and a second member 174. The first member 172 extends vertically from the substrate 110 and the second member 174 extends horizontally from the exterior wall 160 and joins the first member 172. A conventional air vent 176 may be located in the second member 174. A conventional gutter 180 may be attached to the first member 172 by the use of a fastener 182. The gutter 180 serves to direct water falling from the conventional roof 108 away from the structure 109 in a conventional manner.

Having described the conventional roof 108, the process of sealing the conventional roof 108 to achieve the sealed roof 100 of FIG. 1 will now be described.

Figure 4:
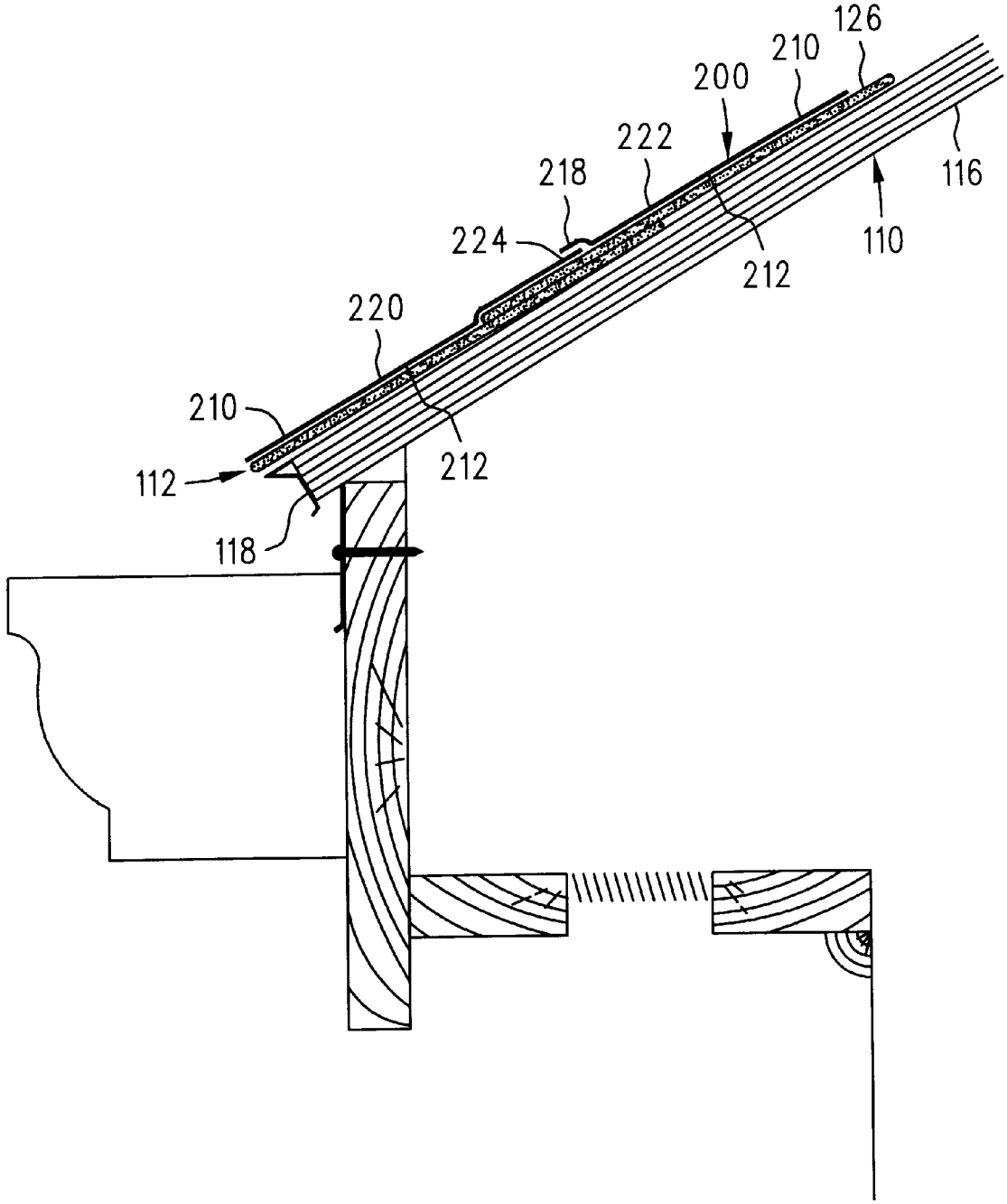
FIG. 4 is a side cut away view of the roof of FIG. 2 with a membrane located thereon.

Referring to FIG. 4, a waterproof membrane 200 may be placed adjacent the top side 126 of the shingles 112. The membrane 200 may be waterproof, durable, and able to conform to the shape of the top side 126 of the shingles 112. This allows the membrane 200 to form a waterproof layer over the shingles 112 that will not tear or otherwise become damaged upon application of a force to the membrane. For example the membrane 200 will not tear if a worker walks on the membrane 200 after it has been placed adjacent the top side 126 of the shingles 112. At least one surface of the membrane 200 may be adhesive or may be adapted to have an adhesive applied thereto. This allows the membrane 200 to adhere to the shingles 112. In addition, the membrane 200 may be inorganic, which prevents it from deteriorating when exposed to water and other deteriorating elements.

The membrane 200 may, as an example of a non-limiting embodiment, be comprised of reinforced styrene-butadiene-styrene (SBS) modified rubberized asphalt. The membrane 200 may be about 50 mils thick and may have a tensile strength of about 50 pounds per inch and a puncture resistance of about 80 pounds per the American Society for Testing and Materials (ASTM) D-412. It should be noted that the tensile strength, puncture resistance, and thickness are examples for illustration purposes and that these values may be lesser or greater depending on the roof to which the membrane 200 is applied. A non-limiting example of the membrane 200 uses polyester for the reinforcing material. Examples of the membrane 200 are of the type commercially available from the Protecto Wrap Company of Denver, Colo. and sold under the tradenames JIFFYSEAL, ICE & WATER GUARD, and RAINPROOF. It should be noted that the use of SBS is for illustration purposes and that other elastomers, polymers, or other similar materials may be substituted for the SBS described herein. Likewise, the use of polyester, as a reinforcing material is for illustration purposes and it is to be understood that other materials may be used to reinforce the membrane 200.

In another non-limiting example of the membrane 200, the membrane 200 may be a rubberized asphalt membrane having a fiberglass core. The membrane 200 may have a thickness of about 90 to 130 mils and a tensile strength of about 50 pounds per inch. This second example of a membrane may, as an example, be of the type commercially available from the NEI corporation of Brentwood, N.H. and sold under the tradename TOP SEAL.

The membrane 200 has a top side 210 and a bottom side 212, both of which are surfaces. The aforementioned thickness of the membrane 200 extends between the top side 210 and the bottom side 212. The bottom side 212 of the membrane 200 may be placed over the shingles 112 that are susceptible to water leakage caused by standing water. For example, the shingles 112 located in the vicinity of the eave 170 that are susceptible to water leakage caused by ice dams may be covered by the membrane 200. The membrane 200 may, as an example, then extend about 68 inches up the roof opposite the direction 120. Alternatively, the membrane 200 may be placed over all the shingles 112, which serves to seal the entire roof.

In a non-limiting embodiment of the membrane 200, the bottom side 212 is adhesive. For example, the bottom side 212 may be self-adhesive, meaning that it adheres to an object upon contacting the object without the addition of other chemicals or actions. The adhesive may, as a non-limiting example, be an SBS rubberized asphalt adhesive. During the application of the membrane 200, the bottom side 212 of the membrane 200 may be placed against the top sides 126 of the shingles 112. This placement of the membrane 200 causes the bottom side 212 of the membrane 200 to adhere to the top sides 126 of the shingles 112. Thus, the membrane 200 may be fully adhered to the top sides 126 of the shingles 112. Alternatively, an adhesive may be applied to either the bottom side 212 of the membrane 200 or the top side 126 of the shingles 112 so as to cause the membrane 200 to adhere to the shingles 112.

It is preferred that the membrane 200 substantially conform to the top sides 126 of the shingles 112. When the membrane 200 substantially conforms to the top sides 126 of the shingles 112, there are few, if any, spaces between the membrane 200 and the shingles 112. The lack of spaces ensures that the membrane 200 will not be subject to excessive tension upon application of a force being applied to the membrane 200. Accordingly, the membrane 200 is less likely to tear or otherwise become damaged upon the application of a force to the membrane 200. For example, when the membrane 200 conforms to the shingles 112, it is less likely to tear if an installer of the membrane 200 walks on the membrane 200. In addition, it is preferred that the membrane 200 not have any wrinkles. Wrinkles may cause the membrane 200 to wear prematurely.

In some applications, a single piece of the membrane 200 is not appropriately sized to cover all the shingles 112 that are susceptible to leakage. For example, referring to FIG. 5, which is a top view of a non-limiting example of the membrane 200, the membrane 200 may be manufactured in strips and packaged in rolls. The strips have a width W1, which may, as an example, be about 30 inches. The top side 210 of the membrane 200 may have a non-adhesive portion 216 and an adhesive portion 218. The adhesive portion 218 has a width W2 which may, as an example, be about 2.5 inches. The adhesive portion 218 may have a non-adhesive strip, not shown, covering and protecting it.

Figure 5:
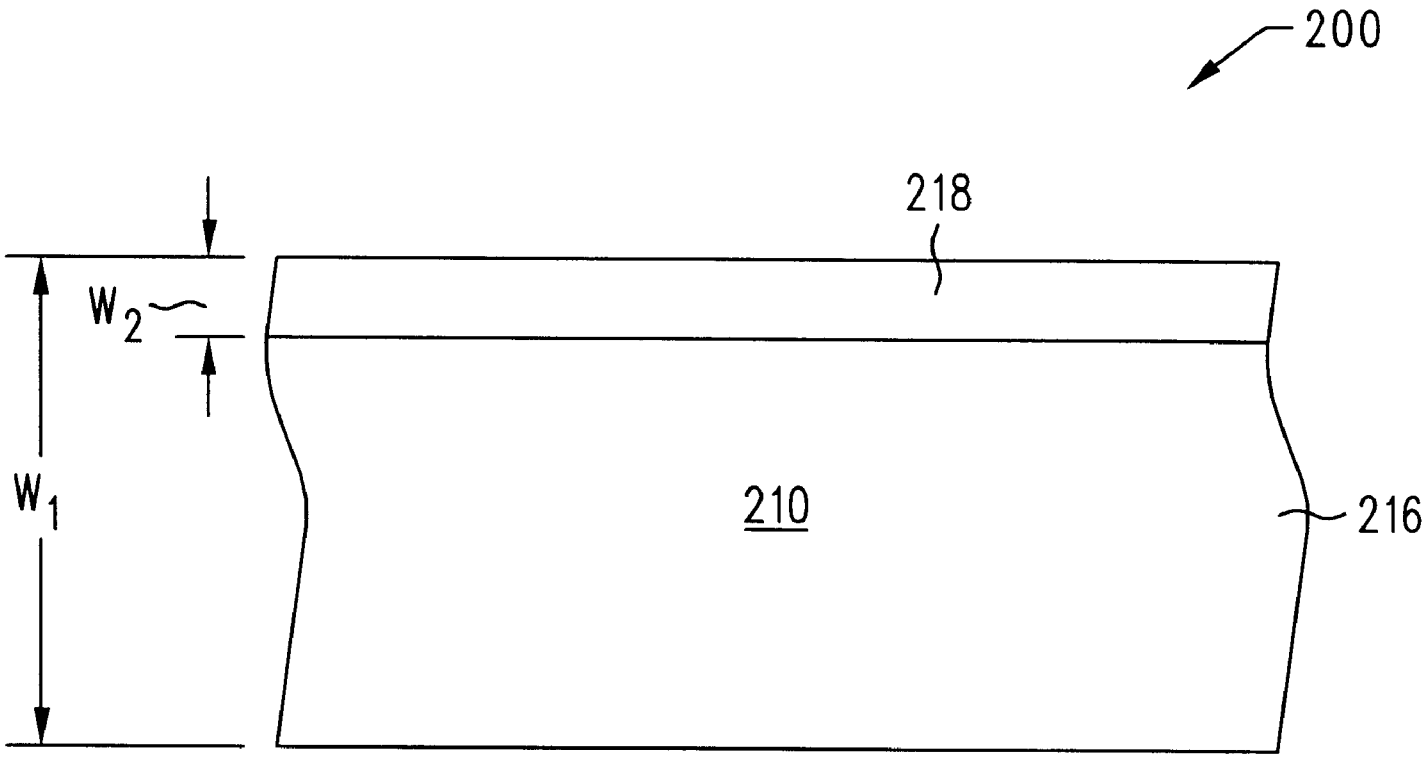
FIG. 5 is an illustration of the membrane of FIG. 4.

Referring to FIGS. 4 and 5, during the application of the membrane 200, a first strip 220 of the membrane 200 may be applied to the shingles 112 in the vicinity of the end 118 of the substrate 110. As described above, the bottom side 212 of the membrane 200 may be adhesive, thus, the bottom side 212 may adhere to the top side 126 shingles 112. When the first strip 220 is applied to the shingles 112, the aforementioned non-adhesive strip, not shown, covering the adhesive portion 218 of the top side 210 is removed exposing the adhesive portion 218. A second strip 222 of membrane 200 may then be placed onto the shingles 112 so that a portion of the bottom side 212 of the second strip 222 contacts the adhesive portion 218 of the first strip 220. Accordingly, an adhesive to an adhesive bond is created between the first strip 220 the second strip 222. This adhesive to adhesive bond, in turn, creates a continuous membrane 200 that is fully adhered to the shingles 112, and serves to form a waterproof layer on the shingles 112.

In order to further assure that the membrane 200 is waterproof, an adhesive may be applied at a junction 224 between the first strip 220 and the second strip 222. The adhesive may, as an example, be a conventional waterproof adhesive applied to form a ⅜ inch bead. In order to yet further assure that the membrane 200 is waterproof, the second strip 222 may overlap the first strip 220 by a distance greater than the width W2 of the adhesive portion 218. An additional bead of waterproof adhesive may be placed between the second strip 222 and the first strip 220.

In some roofing applications, a single strip of membrane 200 may not be long enough to extend the length of the roof. In such an application two strips may be abutted or overlapped. A waterproof adhesive may be placed at the junction of the strips to assure that the strips form a continuous waterproof membrane. For example a length, e.g., six inches, of one strip may overlap an adjacent strip. An adhesive may be applied between the strips at the overlap to improve the waterproof characteristic of the membrane 200.

Referring again to FIG. 1, when the membrane 200 is applied to the shingles 112, a second layer of shingles 230 may be placed on the membrane in an overlapping manner as was described above with reference to the shingles 112. The second layer of shingles 230 may be comprised of conventional roofing shingles as were described with regard to the shingles 112 on the conventional roof 108, FIG. 2. Fasteners 240 may be used to secure the second layer of shingles 230 to the substrate 110. The fasteners 240, such as nails, may pass through the second layer of shingles 230, the membrane 200, the shingles 112, and the substrate 110. Accordingly, the fasteners 240 may affix the second layer of shingles 230 to the substrate 110 and the membrane 200.

The chemical properties of the membrane 200 cause the membrane 200 to form a waterproof seal around the fasteners 240. For example, if the membrane 200 comprises an SBS modified rubberized asphalt, it may form a seal around the fasteners 240 to form a waterproof seal between the membrane 200 and the fasteners 240. Accordingly, the addition of the fasteners 240 does not deter from the waterproof property of the membrane 200 when the fasteners 240 pass through the membrane 200. Additionally, the composition, i.e., polyester reinforcement, of the membrane 200 allows it to contort without tearing or puncturing. Thus, workers installing the second layer of shingles 230 are able to sit and walk on the second layer of shingles 230 without rupturing or otherwise damaging the membrane 200. Likewise, heavy accumulations of ice and snow may build on the sealed roof 100 without rupturing or otherwise damaging the membrane 200.

In addition to the second layer of shingles 230 and the membrane 200, a new drip edge 270 may be applied to the sealed roof 100. The new drip edge 270 may substantially encompasses the drip edge 150. Accordingly, the new drip edge 270 may be installed over the drip edge 150 and removal of the drip edge 150 is not required. Thus, the use of the new drip edge 270 simplifies the above-described sealing process. The new drip edge 270 may be applied between the membrane 200 and the shingles 112 so as to assure that it does not deter from the waterproof characteristics of the sealed roof 100. For example, the drip edge 270 may be attached to the roof prior to the application of the membrane 200.

Having described the application of the membrane 200 on a roof, a description of flashing and sealing vertical walls adjacent the sealed roof 100 will now be described.

Figure 6:
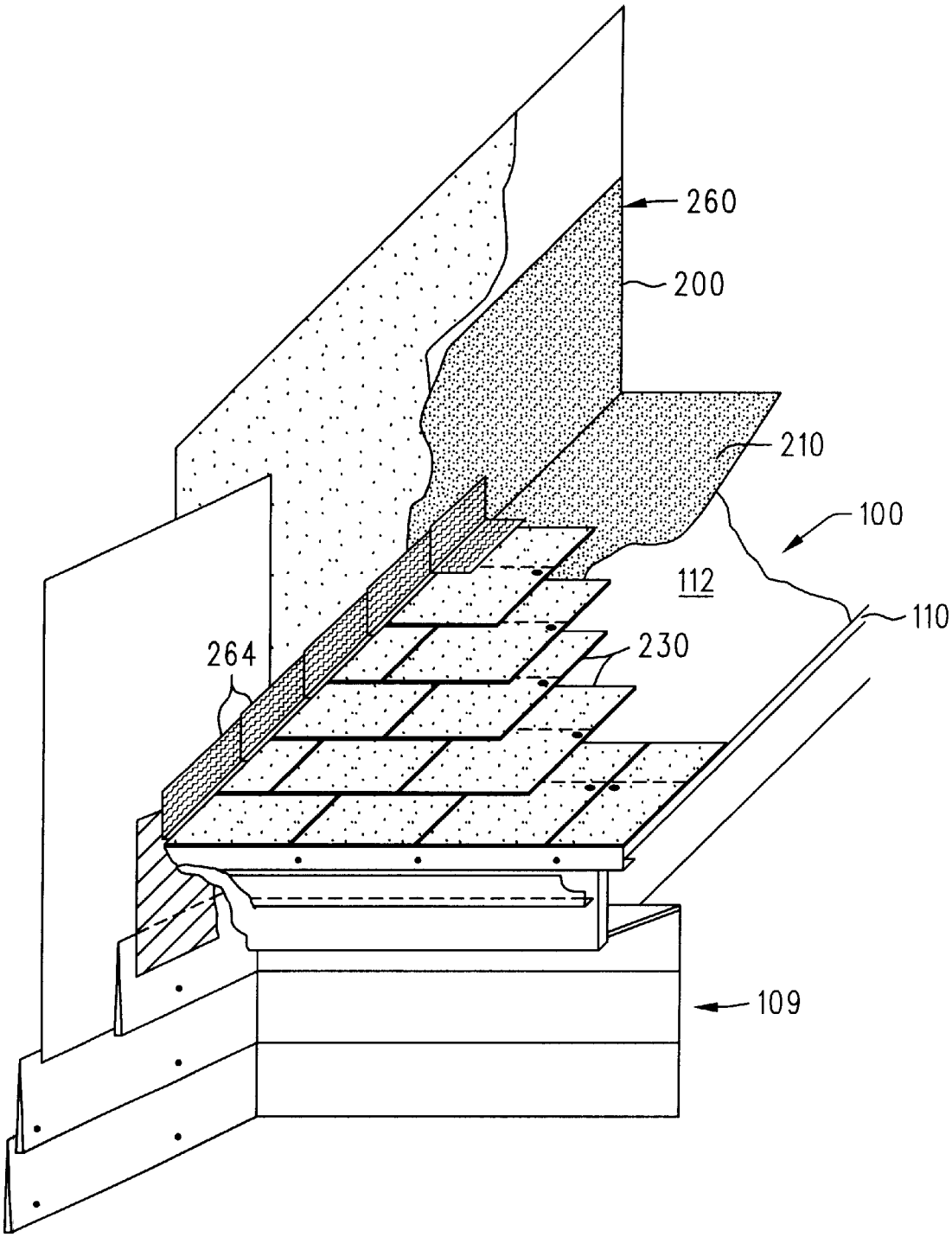
FIG. 6 is a top perspective view of a roof of the type shown in FIG. 1 intersected by a vertical wall.

Referring to FIG. 6, many roofs are intersected by vertical walls and other structures, such as pipes and chimneys. The following description describes sealing these structures with reference to sealing a vertical wall 260 that abuts the sealed roof 100. The vertical wall 260 described herein is a portion of the structure 109 that extends beyond the sealed roof 100. For example, the vertical wall 260 may be an exterior wall of a second level of the structure 109 and the sealed roof 100 may cover a first level of the structure 109.

Sealing the vertical wall 260 may, in summary, comprise affixing the membrane 200 to the vertical wall 260 and extending it up the vertical wall 260. More specifically, siding or other exterior finishes, not shown, may be removed from the vertical wall 260, thus, exposing an underlying substrate, not shown. The membrane 200 may then be applied to the underlying substrate of the vertical wall 260. For example, the membrane 200 be extended from the sealed roof 100 and may be adhered to the vertical wall 260 as described with reference to the shingles 112 shown in FIG. 2. Thus, a continuous waterproof membrane extends from the sealed roof 100 up the vertical wall 260. The membrane 200 may extend to various heights depending on the susceptibility of the vertical wall 260 to water leakage. For example, the membrane 200 may extend up the vertical wall 260 approximately 18 inches from the sealed roof 100. Alternatively, the membrane 200 may fully cover the vertical wall 260. Conventional step flashing 264 may then be placed on the membrane 200 so as to be located beneath the second layer of shingles 230 in a conventional manner. The step flashing 264 further ensures that water does not seep into the vertical wall 260. In addition, the step flashing 264 assures that water will between the vertical wall 260 and the sealed roof 100.

Siding or other conventional finishing materials may be placed over the membrane 200 and secured to the vertical wall 260 in a conventional manner. Fasteners, not shown, may pass through the siding and the membrane 200 to attach the siding to the vertical wall 260. As was described above with reference to the fasteners 240 illustrated in FIG. 1, the membrane 200 seals the fasteners that may be used to secure the siding to the vertical wall 260. Accordingly, the vertical wall 260 and the junction of the sealed roof 100 and the vertical wall 260 are sealed and prevent water from entering the structure 109.

The above-described method of sealing the vertical wall 260 may be applicable to sealing other structures that abut the sealed roof 100. For example, the method may be applied to sealing the junctions between the sealed roof 100 and skylights, chimneys, and ventilation ducts.

Figure 7:
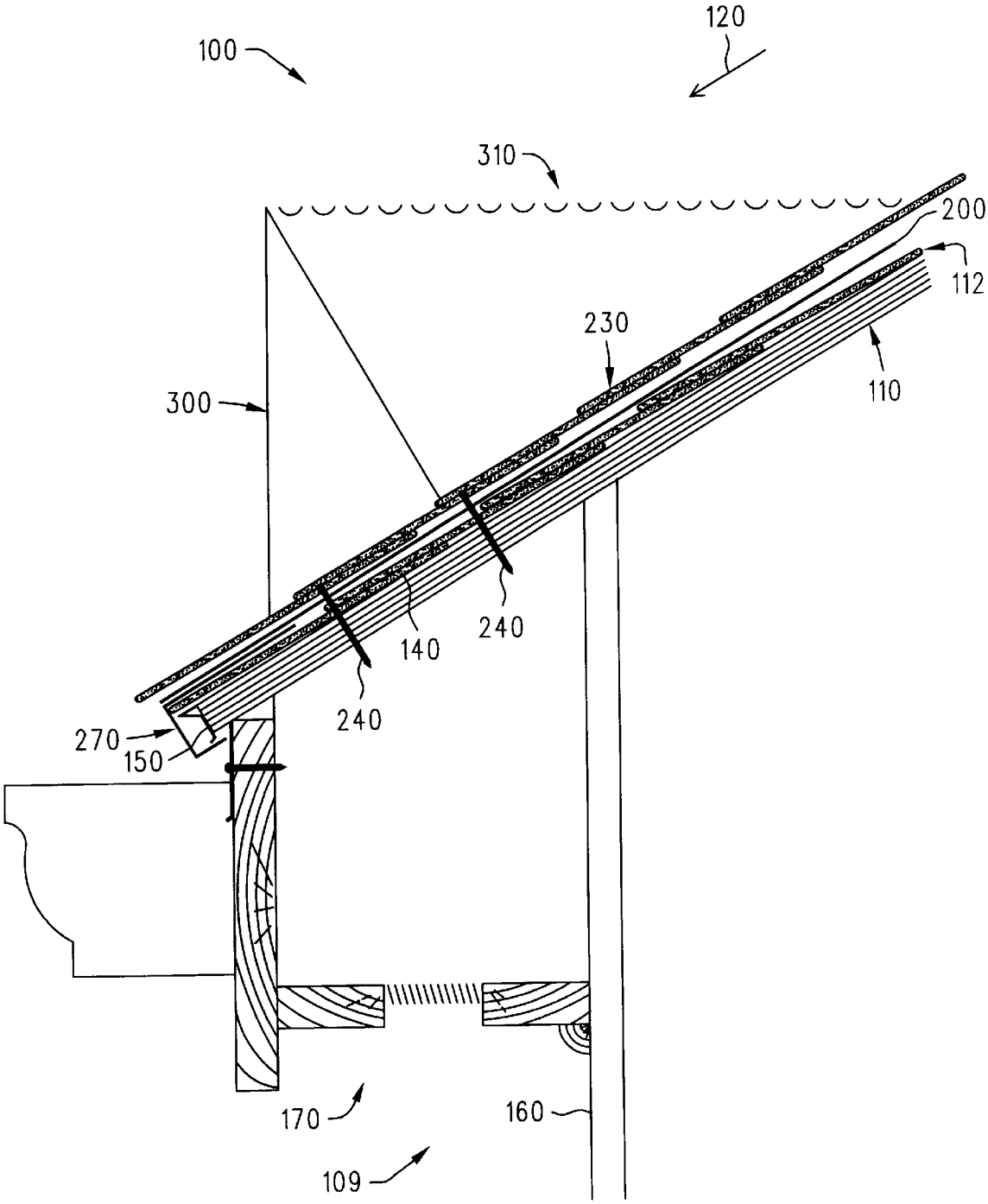
FIG. 7 is a side, cut away schematic illustration of the sealed roof of FIG. 1 with an ice dam located thereon.

Having described the sealed roof 100, FIG. 1, and a method of sealing a conventional roof 108, the sealed roof 100 will now be described repelling water from entering the structure 109. Referring to FIG. 7, which is a side, cut away schematic illustration of the sealed roof 100 of FIG. 1, an ice dam 300 may form above the eave 170 of sealed roof 100. The formation of the ice dam 300 causes water 310 to pool on the sealed roof 100. The water 310 may seep under the second layer of shingles 230 and may contact the membrane 200. The membrane 200 is waterproof and, thus, prevents the water 310 from contacting the substrate 110. Additionally, the membrane 200 seals around the fasteners 240, thus, assuring that the water 310 will not seep around the fasteners 240 to penetrate the substrate 110. Accordingly, the structure 109 is shielded from the water 310.

As outlined above, the ice dam 300 can build up over the eave 170, which will cause water to back up onto the roof. In the situation where vertical structures abut the sealed roof 100, the water 310 will likely contact these structures. For example, referring to FIG. 6, the vertical wall 260 abuts the sealed roof 100. The vertical wall 260, however, has the membrane extending a distance up the vertical wall 260 and, thus, prevents water from entering the structure 109 via the vertical wall 260.

Referring again to FIG. 4, the membrane 200 has been described as either having an adhesive bottom side 212 or having an adhesive applied to the bottom side 212. It should be noted that the top side 210 of the membrane 200 may likewise be adhesive or have an adhesive applied thereto. This permits the second layer of shingles 230, FIG. 1 to be adhered to the membrane 200.

Referring again to FIG. 2, the method of sealing a roof described herein alleviates the need to remove the shingles 112 prior to sealing the roof. This is due to the fact that conventional sealing methods require a membrane to be placed directly to the substrate 110, which requires removal of the shingles 112 in order to access the substrate 110. The shingles 112 are then discarded and a new layer of shingles is attached to the membrane. Removal of the shingles 112, however, tends to be costly. For example costs are associated with the labor to remove the shingles and the costs of disposing the shingles. In addition, the process of removing the shingles 112 may damage the substrate 110. Repairing the substrate 110 further increases the costs of sealing the conventional roof 108. The method disclosed herein overcomes these problems by placing the membrane 200, FIG. 4, onto the shingles 112, thus, not requiring the removal of the shingles 112. Accordingly, the disposal costs and substrate repair costs are eliminated until such a time as the second layer of shingles 230, FIG. 1, is required to be replaced, which is generally 20 to 30 years from the time of installation.

While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

What is claimed is:

1. A method for sealing a roof wherein said roof is of the type comprising an inclined substrate and a first layer of shingles, wherein said first layer of shingles has a first side and a second side, and wherein said first layer of shingles first side is attached to said substrate, said method comprising:

providing a waterproof membrane having a first side and a second side;

providing a second layer of shingles;

positioning said membrane first side adjacent at least a portion of said first layer of shingles second side;

attaching said second layer of shingles to said substrate, wherein said second layer of shingles is adjacent said membrane second side.

2. The method of claim 1 wherein said membrane comprises a polymer.

3. The method of claim 1 wherein said membrane comprises an elastomer.

4. The method of claim 1 wherein said membrane comprises styrene-butadiene-styrene.

5. The method of claim 1 wherein said membrane comprises polyester.

6. The method of claim 1 wherein said membrane comprises asphalt.

7. The method of claim 1 wherein said membrane comprises styrene-butadiene-styrene modified rubberized asphalt.

8. The method of claim 1 wherein said positioning said membrane comprises adhering said membrane first side to at least a portion of said first layer of shingles second side.

9. The method of claim 1 wherein said roof is of the type comprising a membrane positioned between said substrate and said first layer of shingles first side.

10. The method of claim 1 wherein said roof abuts a vertical member, said vertical member extending higher than said roof, and wherein said method further comprises positioning said membrane first side adjacent at least a portion of said vertical member.

11. The method of claim 10 wherein said positioning said membrane comprises adhering said membrane to at least a portion of said vertical member.

12. The method of claim 1 wherein said attaching said second layer of shingles to said substrate comprises attaching said second layer of shingles to said membrane second side.

13. A roof comprising:

an inclined substrate having a surface;

a first layer of shingles attached to said substrate surface, said first layer of shingles having a first surface and a second surface, wherein said first layer of shingles first surface is adjacent said substrate surface;

a membrane having a first surface and a second surface, wherein said membrane first surface is positioned adjacent at least a portion of said first layer of shingles second surface; and a second layer of shingles located adjacent at least a portion of said membrane second surface.

14. The roof of claim 13 wherein said second layer of shingles is attached to said substrate.

15. The roof of claim 13 wherein said membrane comprises an elastomer.

16. The roof of claim 13 wherein said membrane comprises polyester.

17. The roof of claim 13 wherein said membrane comprises a polymer.

18. The roof of claim 13 wherein said membrane comprises styrene-butadiene-styrene.

19. The roof of claim 13 wherein said membrane comprises asphalt.

20. The roof of claim 13 wherein said membrane comprises styrene-butadiene-styrene modified rubberized asphalt.

21. The roof of claim 13 and further comprising a membrane positioned between said substrate surface and said first layer of shingles first side.

22. The roof of claim 13 and further comprising a vertical member abutting said substrate and extending higher than said substrate, wherein said membrane is positioned adjacent at least a portion of said vertical member.

23. The roof of claim 22 wherein said membrane first surface is adhered to at least a portion of said vertical member.

24. The roof of claim 13 wherein said membrane first surface is adhered to at least a portion of said first layer of shingles second surface.

* * * * *